United States Patent [19]

Scalamandre et al.

[11] Patent Number: 4,678,156

[45] Date of Patent: Jul. 7, 1987

[54] REUSABLE CONCRETE FORMS WITH SPACER/TIERODS

[75] Inventors: Joseph Scalamandre, Freeport; John J. Vigilante, Glendale, both of N.Y.

[73] Assignees: Fred Scalamandre, Freeport; Michael L. Vigilante, Massapequa Park, both of N.Y. ; a part interest

[21] Appl. No.: 687,834

[22] Filed: Dec. 31, 1984

[51] Int. Cl.[4] ..... E04G 17/12

[52] U.S. Cl. ..... 249/34; 249/40; 249/44; 249/191; 249/215; 249/216

[58] Field of Search ..... 249/40, 216, 2, 4, 5, 249/8, 18, 33, 34, 36, 38, 208, 213, 214, 215, 218, 219 R, 44, 190, 191; 52/699, 712, 715

[56] References Cited

U.S. PATENT DOCUMENTS

| | | | |
|---|---|---|---|
| 1,126,190 | 1/1915 | Fuehrer | 249/216 |
| 1,488,726 | 4/1924 | Alexander et al. | 249/218 |
| 1,564,982 | 12/1925 | Smith | 249/216 |
| 1,720,697 | 7/1929 | Smith | 249/40 |
| 1,725,827 | 8/1929 | Pontiere | 249/36 |
| 1,746,298 | 2/1930 | Alley | 249/213 |
| 1,776,438 | 9/1930 | Kinninger | 249/218 |
| 2,378,850 | 6/1945 | Hyre | 249/216 |
| 2,490,228 | 12/1949 | Pontiere | 249/22 |
| 2,524,265 | 10/1950 | Kravagna | 249/218 |
| 3,284,043 | 11/1966 | Campo | 249/216 |
| 3,417,958 | 12/1968 | Rugger | 249/216 |
| 3,547,397 | 12/1970 | Brow, Jr. | 249/40 |
| 3,697,039 | 10/1972 | Phelps et al. | 249/219 R |
| 4,291,858 | 9/1981 | Nesmith | 249/216 |

FOREIGN PATENT DOCUMENTS

| | | | |
|---|---|---|---|
| 712077 | 6/1965 | Canada | 249/40 |
| 1174473 | 7/1964 | Fed. Rep. of Germany | 249/213 |
| 2320019 | 3/1974 | Fed. Rep. of Germany | 249/213 |
| 788762 | 1/1958 | United Kingdom | 249/44 |

*Primary Examiner*—Jay H. Woo
*Assistant Examiner*—James C. Housel
*Attorney, Agent, or Firm*—Ostrolenk, Faber, Gerb & Soffen

[57] ABSTRACT

A spacer/tie rod to space and hold reusable sections of concrete molds is, according to the principal embodiment of this invention, constructed of two main elements and two auxiliary elements cut from the same small diameter steel rod stock. The main elements are identical, with each having an elongated central section and upturned indexing sections at each end, while the auxiliary elements are identical and straight. The latter are welded to the former at positions where the auxiliary elements are spaced apart by a distance equal to a wall thickness, and the distance between each auxiliary element and the main element indexing section nearest to said auxiliary element is equal to the thickness of the frame that stiffens a form section. The indexing sections of the main elements are tool bendable between form positioning and form holding positions.

21 Claims, 12 Drawing Figures

46
36
33
31
11
35
34
32
45
47
37
66
53
61
51
56
12
54
62
52
55
63
65
67
64
57
22
23

FIG. 7
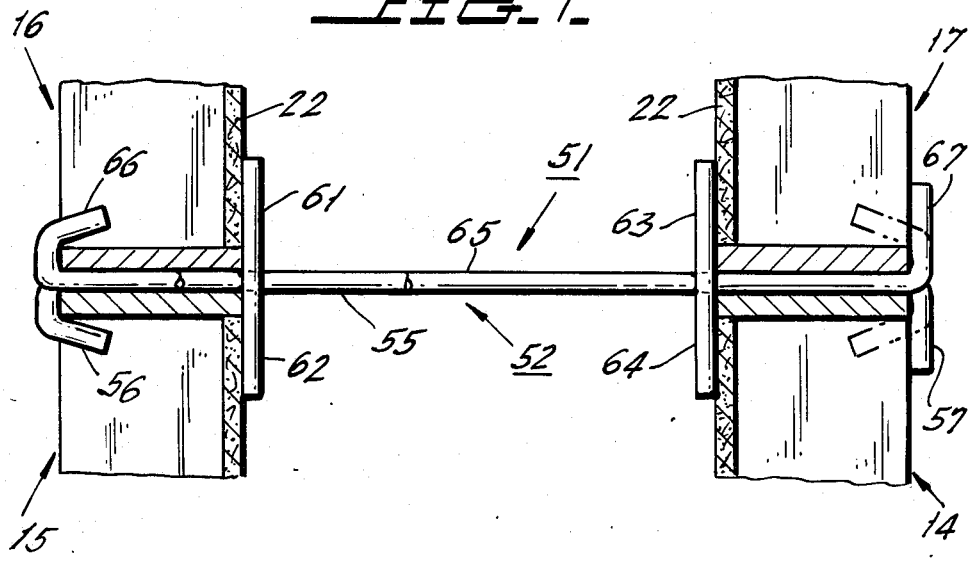
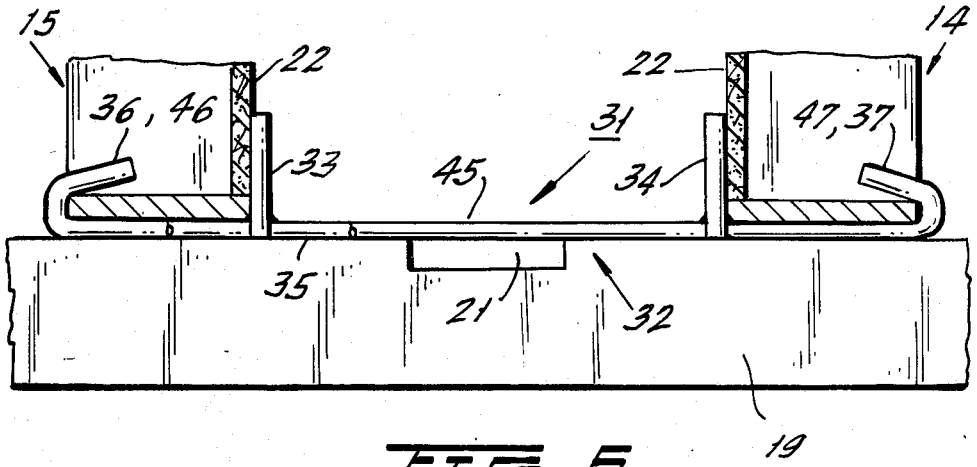
FIG. 6

REUSABLE CONCRETE FORMS WITH SPACER/TIERODS

This invention relates to molds used for manufacturing concrete objects, and particularly relates to spacer/-tie rod means for securing reusable mold sections in a predetermined spaced relationship.

BACKGROUND OF THE INVENTION

The accurate placement of forms used for in situ production of poured concrete structural elements such as walls, footings and curbs is time consuming, hence costly. This was often the result of the fact that such forms are usually constructed of reusable sections that must be accurately aligned with each other and positioned so that the resulting structural element is located precisely according to building plan. Typically in the prior art, adjacent form sections are releasably connected to each other by utilizing reusable so-called wedge-bolts, and spaced confronting portions of the form are positioned by sacrificial tie rods.

At least the ends of each prior art tie rod are threaded to receive nuts that are used to properly space confronting form portions and to receive additional nuts that hold or prevented these form portions from separating. These rods were relatively expensive, locating them often presented problems, and operating the nuts was time consuming, both when applying and when removing same, especially when the threads became contaminated with cement.

SUMMARY OF THE INVENTION

In accordance with the principal embodiment of this invention, a spacer/tie rod is constructed of four elements, all of which are cut from the same small diameter metal rod stock. Two of these elements, the main elements, are identical, with each having an elongated main section and relatively short indexing formations at opposite ends of the main section. The other two elements (the auxiliary elements) are identical to each other, being secured to the main sections at locations that are inboard from the ends of the main sections by a predetermined distance equal to the thickness of the stiffening frame for a mold section. In one embodiment of this invention, the ends of one main element extend in a direction opposite to the ends of the other main element and the length of each of the two auxiliary elements is equal to approximately twice the length of an end section. The spacing between the two auxiliary elements is equal to the desired spacing between the facing form sections. The ends of the main elements are tool bendable to engage the mold section frame in a holding relationship during the concrete pouring operation. When this operation is completed and the form is to be dismantled, the end portions of the spacer/tie rod are cut off by a tool or are bent to a position which will permit release of the mold section frame.

In another embodiment of this invention, used at the very bottom of the form, the ends of both main sections of the spacer/tie rod are parallel to one another and the auxiliary elements are approximately the length of a single one of the end sections.

In one modification of the foregoing, one of the main rod elements is made shorter than the other, typically for a situation where a narrow wall extends upward from a thick footing. In another modification, for each main element, one turned end and the auxiliary element closest thereto are disposed in a plane that is perpendicular to the plane in which the other turned end and the other auxiliary element are disposed. For some applications, only one end of the main section need be bent at right angles and have an auxiliary element parallel thereto. In this last noted modification, the other end of the main element is deformed and is positioned in a locating hole by a grout.

Accordingly, a primary object of the instant invention is to provide a novel construction for a spacer/tie means used in connection with reusable concrete forms.

Another object is to provide spacer/tie means of this type that is reliable and is convenient to use.

Still another object is to provide a spacer/tie means of this type that does not require any threaded members.

A further object is to provide a spacer/tie means of this type that is constructed solely of a single size and type of rod stick.

It is a further objection to provide a spacer/tie means of this type having tool bendable holding formations that engage the mold section frames.

BRIEF DESCRIPTION OF THE DRAWINGS

The foregoing objects as well as other objects of the instant invention shall become readily apparent after reading the following description of the accompanying drawings in which:

FIG. 6 is a side elevation of the spacer/tie rod of FIG. 2 looking in the direction of arrows 6—6 of FIG. 1.

FIG. 7 is a side elevation of the spacer/tie rod of FIG. 4 looking in the direction of arrows 7—7 of FIG. 1.

DETAILED DESCRIPTION OF THE INVENTION

Figure 1:
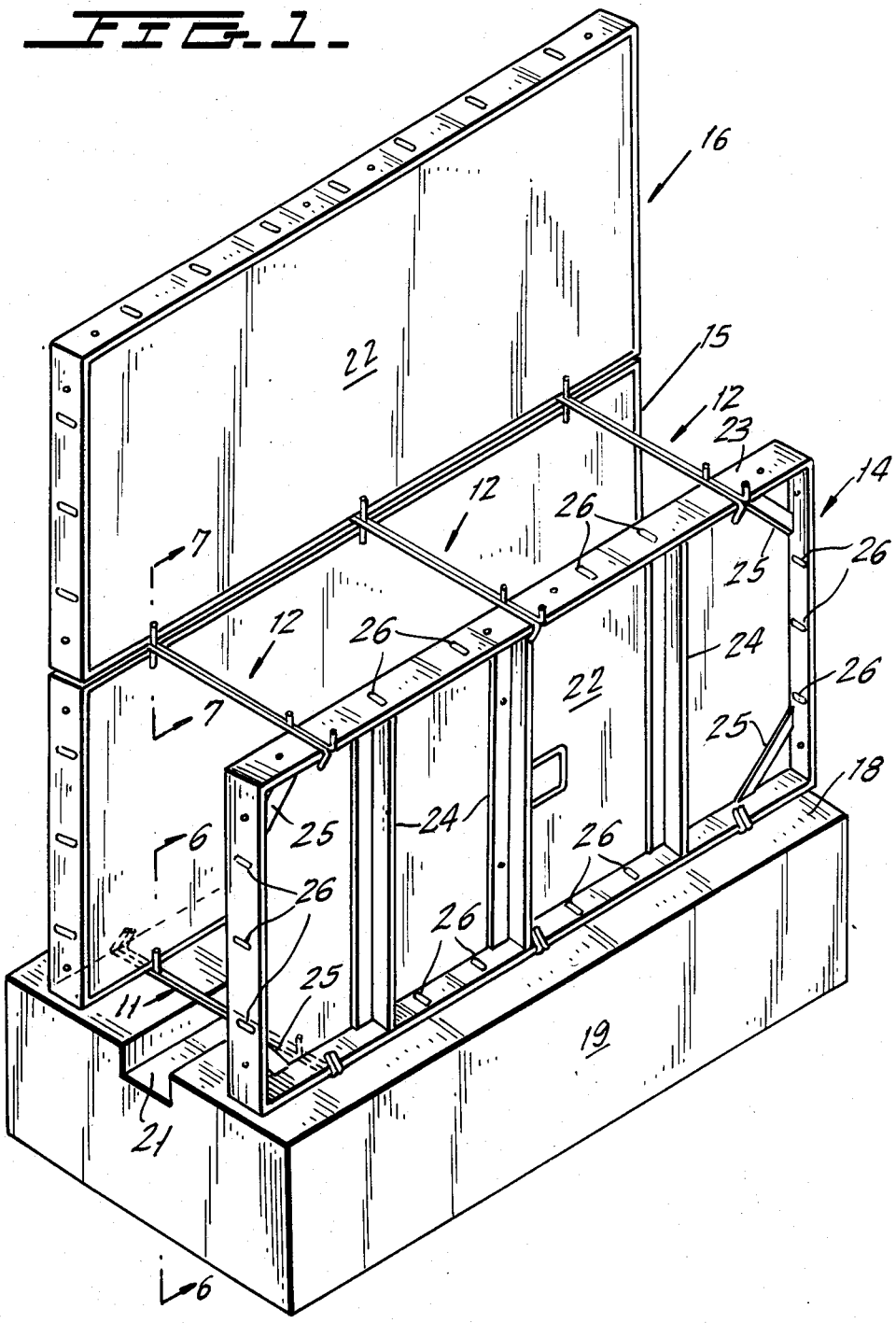
FIG. 1 is a perspective showing a plurality of form sections being held and spaced by spacer/tie rod constructed in accordance with teachings of the instant invention.

Now referring to the figures and more particularly to FIG. 1 which shows three spacer/tie rods 11 (FIG. 2) and three spacer tie rods 12 (FIG. 4) in operative engagement with spaced confronting form sections 14, 15. In addition, spacer/tie rods 12 also operatively engage form section 16 that is identical with the other two form sections 14, 15 and is in vertical alignment with the latter. As seen in FIG. 7, another identical form section 17 that is in spaced parallel relationship with form section 16 is also engaged by spacer/tie rod 12 to vertically align form sections 14 and 17. The three spacer/tie rods 11 rest on upper surface 18 of concrete footing 19 and extend over longitudinal gutter 21 thereof. Each of the form sections 14–17 include plywood sheet 22 whose periphery is surrounded by rectangular metal frame 23 that is strengthened by three transverse parallel angle irons 24 and diagonal braces 25 in each corner. Sheet 22 rests against angle irons 24 and diagonal elements 25, all of which are positioned so that the outer face of sheet 22 is coplanar with one edge of frame 23. Typically, each of the form sections 14–18 measures 2′×4′. In a manner well known to the art, frame 23 is provided with a plurality of transverse slots 26 which receive so called wedge bolts or other means for mechanically securing adjacent form sections together.

Each of these spacer/tie rods 11 and 12 is constructed exclusively of steel rod stock of ¼″ diameter. In particular, spacer/tie rod 11 is constructed of two identical elongated main elements 31, 32 and two much shorter identical auxiliary elements 33, 34. Main element 31 includes elongated central section 35 and short upturned end sections 36, 37, while main element 32 includes elongated central section 45 and upturned end sections 46, 47. Collectively, ends 36, 46 constitute an indexing formation that is spaced from another indexing formation, formed by element 33, by a predetermined distance equal to the width of the member forming frame 23. Spaced apart by this same predetermined distance are indexing formations 37, 47 and the indexing formation formed by element 34. Elements 33, 34 extend between central sections 35, 45 and are welded to both so that elements 31–34 form a unitary structure.

As seen in FIG. 1, central sections 35, 45 rest on upper surface 18 of footing 19 so that all of the indexing formations 33, 34, (36, 46), (37, 47) extend upwardly. When these form sections 14, 15 are being brought into engagement with spacer/tie rods 11, indexing formations 36, 46 and 37, 47 are in vertical locating positions. Thereafter, utilizing a hammer or a suitable lever-like tool (not shown) formations 36, 46 and 37, 47 are bent inwardly to the holding positions shown in FIGS. 3 and 6 to mechanically secure form sections 14, 15 to rods 11 with the confronting faces of their plywood sections being spaced apart by the desired wall thickness as determined by the spacing between indexing formations 33 and 34. To release form sections 14, 15 after a wall is poured and set, formations 36, 46 and 37, 47 are removed by a cutter or are bent outwardly by a suitable tool.

Figures 2, 3, 4, 5:
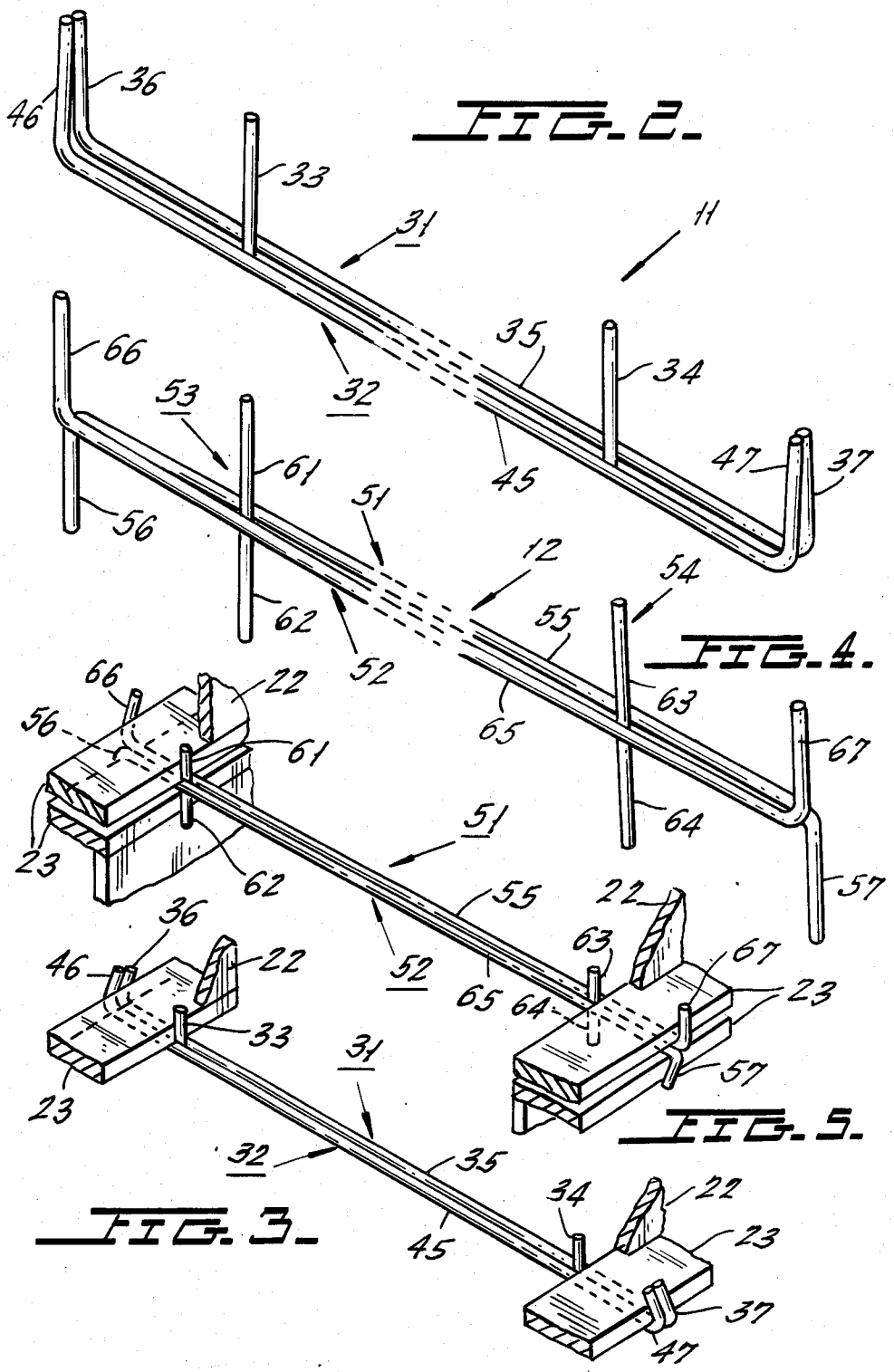
FIG. 2 is a perspective of a spacer/tie rod that engages the lowermost form sections.
FIG. 3 is a perspective of the spacer/tie rod of FIG. 2 in engagement with two form sections.
FIG. 4 is a perspective of a spacer/tie rod that is used in cooperation with intermediate ones of the form sections.
FIG. 5 is a perspective of the spacer/tie rod of FIG. 4 in operative engagement with four form sections.

Spacer/tie 12 of FIG. 4 includes two main elements 51, 52 that have identical structures which are the same as elements 31, 32 in FIG. 2. Spacer/tie rod 12 also includes two auxiliary members 53, 54 that are relatively short but are approximately twice as long as elements 33, 34. The ends 56, 57 of element 51 are downwardly turned while the ends 66, 67 of element 52 are upwardly turned. Elements 53, 54 extend between the elongated central sections 55, 65 of the respective main elements 51, 52 and are welded to both. Equal lengths of each of the elements 53, 54 extend above and below central sections 55, 65 so that element 53 constitutes respective upwardly and downwardly extend indexing formations 61, 62 and element 54 constitutes respectively upwardly and downwardly extending indexing formations 63, 64. The spacing between element 53 and ends 56, 66 is equal to the spacing between element 54 and ends 57, 67. This spacing is the same as the spacing between element 34 and ends 37, 47 and the spacing between elements 53 and 54 is equal to the spacing between elements 33 and 34. Just as ends 36, 46 and 37, 47 are inwardly bendable to holding positions, so to are ends 56, 57, 66, 67.

By constructing the spacer/tie rods of FIGS. 1–7 exclusively of elements cut from rod stock of relatively small diameter (typically ¼″), and by having these elements require welding at only two locations, a relatively inexpensive device is obtained. This device is conveniently utilized by merely bending the ends of the main element between locating and holding positions.

Figure 9:
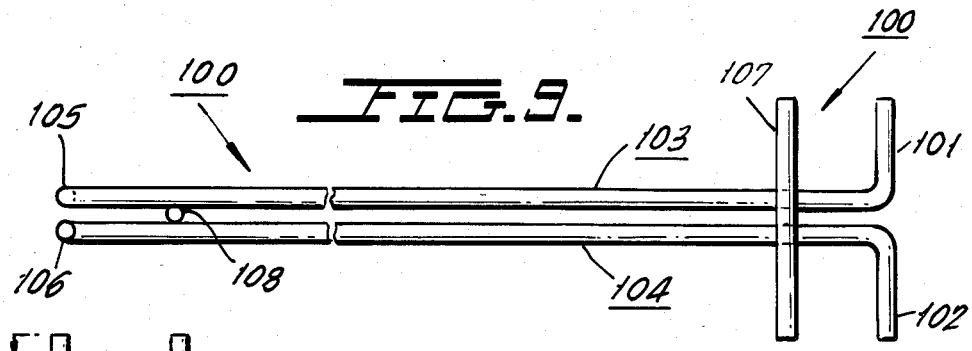
FIG. 9 is a plan view of the embodiment of FIG. 8 looking in the direction of arrows 9—9.
Figure 8:
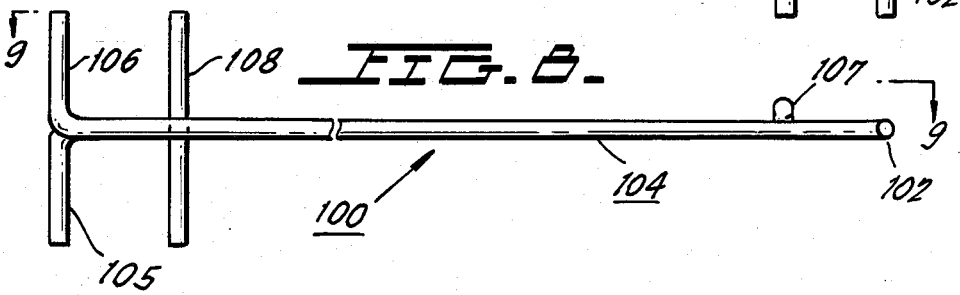
FIG. 8 is a side elevation of another embodiment of this invention.

Spacer/tie rod 100 illustrated in FIGS. 8 and 9 is of essentially the same construction as spacer tie/rod 12 of FIG. 4, the essential difference being that the indexing turned ends 101, 102 of the respective main elements 103, 104 are horizontal while the indexing turned ends 105, 106 of the respective main elements 103, 104 are vertical. Auxiliary element 107, welded to main elements 103, 104 in the vicinity of ends 101, 102, is horizontal, while auxiliary element 108 welded to main elements 103, 104 in the vicinity of ends 105, 106 is vertical. In this embodiment, main elements 103, 104 are identical and auxiliary elements 107, 108 are also identical.

Figure 11:
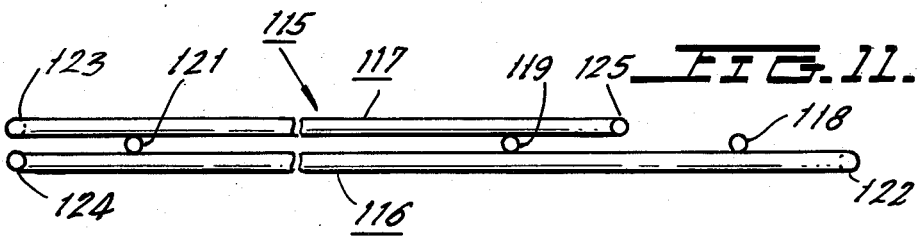
FIG. 11 is a plan view of the embodiment of FIG. 10 looking in the direction of arrows 11—11.
Figure 10:
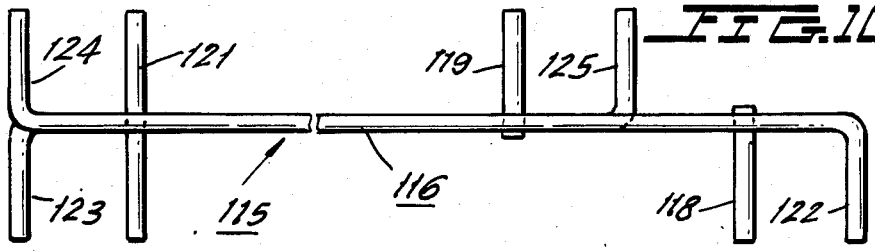
FIG. 10 is a side elevation of still another embodiment of this invention.

In the embodiment of FIGS. 10 and 11, spacer/tie rod 115 is constructed of relatively long main element 116 and relatively short main element 117 as well as two short auxiliary elements 118, 119 and one long auxiliary element 121. The ends 122, 123 of main element 116 are bent downwardly to vertical positions and constitute indexing formations that cooperates with the respective auxiliary elements 118, 121, while ends 124, 125 are bent upward to vertical positions to form indexing formations that cooperate with the respective auxiliary elements 121, 119. Indexing formations 123, 124 are positioned in a common vertical plane. The spacing between auxiliary elements 119 and 121 determines the thickness of a poured concrete relatively thin wall (not shown) that will extend from a relatively thick poured concrete footing (not shown) whose width is determined by the spacing between auxiliary elements 118 and 121.

Figure 12:
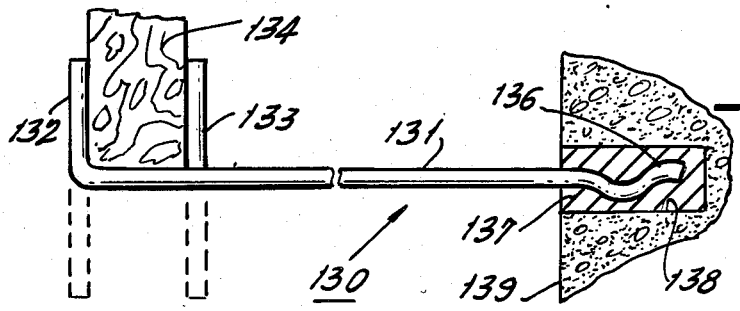
FIG. 12 is a side elevation of a further embodiment of this invention.

In the embodiment of FIG. 12, spacer/tie rod 130 is constructed of elongated main element 131 whose left end 132 is upwardly bent to constitute an indexing formation. Auxiliary element 133 welded to main element 131 is of essentially the same height as end 132 and extends parallel thereto. The spacing between auxiliary element 133 and end 132 is illustrated as being relatively narrow to accommodate wooden form element 134 that is not provided with a stiffening frame. Naturally, when form members similar to members 22 are to be accommodated between element 133 and end 132, the spacing between the latter will equal the thickness of stiffening frame member 23. Right end 136 of main element 131 is deformed and is intended to be set in grout 137 that fills hole 138 drilled in wall 139.

It should now be apparent to those skilled in the art that for any of the embodiments illustrated, the spacing between an indexing end and its cooperating auxiliary element will be made to be compatible with the thickness of the form members being utilized. Now it should also be apparent that any modifications of the specific embodiments described may be made by combining portions of different embodiments. For instance, in the embodiment of FIG. 12, main element 131 may consist of two rods that are parallel, at least in the horizontal run, and downwardly extending indexing formations (indicated in phantom) may be provided.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A reusable form, for in situ construction of poured concrete, the form comprising a plurality of sections each having a sheet-like structure stiffened by a peripheral frame and spacer/tie means holding opposing form sections in a spaced relationship, the spacer/tie means comprising:

an elongated main portion;

first and second indexing formations on said main portion at opposite ends thereof, and third and fourth indexing formations on said main portion at fixed locations along the length thereof with said locations being a predetermined distance inboard of the respective first and second indexing formations;

said predetermined distance being substantially equal to the thickness of a section of the frame and the distance between the third and fourth indexing formations being equal essentially to the thickness of a wall to be poured;

said first and second indexing formations being tool bendable with respect to said main portion;

said first and second formations extending from said main portion inwardly toward one another and over the frames of a first pair of opposing form sections, firmly holding said first pair of form sections against vertical movement with respect to said main portion.

2. A reusable form as set forth in claim 1 in which the spacer/tie means also comprises:

fifth and sixth indexing formations on said main portion at opposite ends thereof, and seventh and eighth formations on said main portions disposed inboard of the respective fifth and sixth indexing formations by said predetermined distance;

said third and fourth formations extending from said main portion in a first direction opposite to a second direction in which said seventh and eighth sections extend from said main portion;

said fifth and sixth indexing formations being tool bendable;

said fifth and sixth indexing formations being inwardly bent toward one another and over the frames of a second pair of opposing form sections, wherein each section of said second pair of form sections is coplanar with a respective section of said first pair of form sections.

3. A reusable form as set forth in claim 1 in which the main portion comprises first and second parallel rods and said third and fourth indexing formations comprises respective first and second elements that are interposed between said first and second rods.

4. A reusable form as set forth in claim 3 in which the first and second indexing formations are integrally formed with said main portion.

5. A reusable form as set forth in claim 3 in which each of said first and second indexing formations comprise first and second parallel sections integrally formed with the respective first and second rods.

6. A reusable form as set forth in claim 2 in which the main portion comprises first and second parallel rods; said first and second indexing formations are integrally formed with said first rod; said fifth and sixth indexing formations being integrally formed with said second rod.

7. A reusable form as set forth in claim 6 in which the first rod and its integrally formed first and second indexing formations is of the same size and shape as the second rod and its integrally formed fifth and sixth indexing formations.

8. A reusable form as set forth in claim 2 in which the main portion comprises first and second parallel rods; said third and seventh indexing formations comprising a single rod element that extends between said first and second rods; said fourth and eighth indexing formations comprising another single rod element that extends between said first and second rods.

9. A reusable form as set forth in claim 8 in which said first and second indexing formations are integrally formed with said first rod; said fifth and sixth indexing formations being integrally formed with said second rod.

10. A reusable form as set forth in claim 9 in which the first rod and its integrally formed first and second indexing formations is of the same size and shape as the second rod and its integrally formed fifth and sixth indexing formations.

11. A reusable form as set forth in claim 10 in which the third, fourth, seventh and eighth indexing formations are essentially of the same length.

12. A reusable form as set forth in claim 10 in which the first, second, fifth and sixth indexing formations are essentially of the same length.

13. A reusable form as set forth in claim 10 in which all of said indexing formations are essentially of the same length.

14. A reusable form as set forth in claim 10 in which the rods and rod elements are constructed of the same size and type of rod.

15. A reusable form as set forth in claim 1 in which the spacer/tie means also comprises:

fifth and sixth indexing formations on said main portion at opposite ends thereof, and seventh and eighth formations on said main portions disposed inboard of the respective fifth and sixth indexing formations by said predetermined distance;

said fifth and sixth indexing formations being tool bendable relative to said main portion;

said fifth and sixth indexing formations being inwardly bent toward one another and over the frames of a second pair of opposing form sections, wherein each section of said second pair of form sections is coplanar with a respective section of said first pair of form sections;

16. A reusable form as set forth in claim 15 in which the main portion comprises first and second parallel rods; said first and second indexing formations are integrally formed with said first rod; said fifth and sixth indexing formations being integrally formed with said second rod.

17. A reusable form as set forth in claim 16 in which the first rod and its integrally formed first and second indexing formations is of the same size and shape as the second rod and its integrally formed fifth and sixth indexing formations.

18. A reusable form, for in situ construction of poured concrete, the form comprising a plurality of sections each having a sheet-like structure stiffened by a peripheral frame and spacer/tie means holding opposing form sections in a spaced relationship, the spacer/tie means comprising:

an elongated main portion;

first and second indexing formations on said main portion at opposite ends thereof, and third and fourth indexing formations on said main portion at fixed locations along the length thereof with said locations being a predetermined distance inboard of the respective first and second formations;

said predetermined distance being substantially equal to the thickness of a section of the frame and the distance between the third and fourth indexing formations being equal essentially to the thickness of a footing to be poured;

said third and fourth indexing formations being perpendicular to said main portion and generally parallel to said first and second indexing formations;

a fifth indexing formation at one end of said main portion and a sixth indexing formation intermediate the ends of said main portion;

seventh and eighth indexing formations on said main portion disposed inboard of the respective fifth and sixth indexing formations by said predetermined distance;

said first and fifth indexing formations extending in opposite directions from said main sections;

said second and sixth indexing formations extending in opposite directions from said main section;

said seventh and eighth indexing formations being spaced from each other by a distance equal essentially to the thickness of a wall to be poured above a footing;

said first and second indexing formations being inwardly bent toward one another over the frames of a first pair of opposing form sections and said fifth and sixth indexing formations being inwardly bent toward one another over the frames of a second pair of opposing form sections.

19. A reusable form used for in situ construction of poured concrete structural elements such as walls and curbs, and spacer/tie means in engagement with said reusable form to locate and maintain sections thereof in operative positions;

said reusable form comprising a plurality of sections each of which includes a sheet-like form stiffened by a peripheral frame;

said spacer/tie means comprising an elongated portion, first and second indexing formations on said main portion at opposite ends thereof, and third and fourth indexing formations on said main portion at fixed locations along the length thereof with said locations being a predetermined distance inboard of the respective first and second indexing formations;

said frame having a thickness that is substantially equal to the predetermined distance and the distance between the third and fourth indexing formations is equal essentially to the thickness of a wall to be poured;

said first and second indexing formations being tool bendable with respect to said main portion;

said first and second formations extending from said main portion inwardly toward one another and over the frames of first and second opposing form sections, firmly holding the frames in their respective operative positions.

20. A reusable form and spacer/tie means as set forth in claim 19 in which the main portion comprise first and second parallel rods and said third and fourth indexing formations comprise respective first and second elements that are interposed between said first and second rods.

21. A reusable form and spacer/tie means as set forth in claim 19 in which the latter also comprises;

fifth and sixth indexing formations on said main portion at opposite ends thereof, and seventh and eighth formations on said main portions disposed inboard of the respective fifth and sixth indexing formations by said predetermined distance;

said third and fourth formations extending upward from said main portion in a first direction and said seventh and eight sections extending downward from said main portion;

said fifth and sixth indexing formations being tool bendable relative to said main portion;

third and fourth opposing form sections disposed below said main portion and being coplanar with a respective one of said first and second sections, with an upper edge portion of said third section being entered between said fifth and seventh formations and an upper edge portion of said fourth section being entered between said sixth and eighth formations;

said fifth and sixth formations extending from said main portion inwardly toward one another and over the frames of said third and fourth sections, firmly holding the frames in their respective operative positions against downward movement with respect to said main portion.

* * * * *